US005607554A

United States Patent [19]

Poikolainen

[11] Patent Number: 5,607,554

[45] Date of Patent: Mar. 4, 1997

[54] LOADING BOX FOR A FORMER OF A PAPER OR BOARD MACHINE

[75] Inventor: Antti Poikolainen, Jyväskylä , Finland

[73] Assignee: Valmet Corporation, Helsinki, Finland

[21] Appl. No.: 433,609

[22] Filed: May 3, 1995

[30] Foreign Application Priority Data

May 3, 1994 [FI] Finland ..... 942028

[51] Int. Cl.[6] ..... D21F 1/00; D21F 1/52; D21F 1/54

[52] U.S. Cl. ..... 162/210; 162/203; 162/300; 162/301; 162/352

[58] Field of Search ..... 162/203, 205, 162/210, 300, 301, 352, 354

[56] References Cited

U.S. PATENT DOCUMENTS

| | | | |
|---|---|---|---|
| 4,769,111 | 9/1988 | Nevalainen et al. | 162/301 |
| 4,988,408 | 1/1991 | Evalahti | 162/301 |
| 5,061,347 | 10/1991 | Bubik et al. | 162/301 |
| 5,116,477 | 5/1992 | Bubik et al. | 162/352 |
| 5,167,770 | 12/1992 | Bubik et al. | 162/352 |
| 5,185,064 | 9/1993 | Nyman | 162/352 |
| 5,262,010 | 11/1993 | Bubik et al. | 162/352 |
| 5,387,320 | 2/1995 | Jaakkola | 162/352 |

*Primary Examiner*—Karen M. Hastings
*Attorney, Agent, or Firm*—Steinberg, Raskin & Davidson, P.C.

[57] ABSTRACT

A loading box adjustable in zones thereof for a former of a paper or board machine. The former comprises a twin-wire section including two wires placed one above the other and running in the same transfer direction. In the twin-wire section, a drain box is mounted at one side of the wires to remove water out of a fibrous pulp running between the wires. At the opposite side of the wires, a loading box is mounted and is provided with loading ribs arranged in the transverse direction in relation to the transfer direction and which extend across the web width. The loading ribs are loaded toward the bottom of the drain box in order to produce a desired compression in the fibrous pulp running between the wires. The loading box is provided with loading members arranged to produce a locally raising or lowering force applied to the loading ribs in the direction transverse to the transfer direction. The force is applied simultaneously to at least two successive loading ribs to profile the compression force applied by the loading ribs to the fibrous pulp in the transverse direction.

19 Claims, 7 Drawing Sheets

LOADING BOX FOR A FORMER OF A PAPER OR BOARD MACHINE

BACKGROUND OF THE INVENTION

The present invention relates to a loading box adjustable in zones thereof for a former of a paper or board machine, which former comprises a twin-wire section consisting of two wires placed one above the other and running in the same direction. In the twin-wire section, a drain box is mounted on one side of the wires and removes water from a fibrous pulp running between the wires. Also in the twin-wire section, a loading box is mounted at the opposite side of the wires, and preferably in opposed relationship to the drain box, and is provided with a number of loading ribs which are placed in the transverse direction in relation to a transfer direction in which the wires run and which extend across the web width. The loading ribs are loaded toward the bottom of the drain box in order to produce a desired compression in the fibrous pulp running between the wires.

Conventionally, a former of a paper machine comprises a twin-wire section in which an upper wire and a lower wire run substantially parallel and one above the other (in a horizontal former). The fibrous pulp is introduced between the wires for draining. On the top of the upper wire, there is a drain box in which a vacuum is maintained in order to absorb water out of the fibrous pulp. The lower wire is normally supported by means of a loading box which is provided with loading ribs transverse to the running direction of the wires and which is stationary in relation to the drain box. In such a former, it is desirable that the magnitude of the gap between the wires can be changed and that the shape of the gap in relation to the transfer direction of the wires can also be changed. For this purpose, in the prior art, a number of different modes have been described for guiding and supporting the wires.

For example, in DE Patent No. 3,406,217, a wire guide path is described in which the lower wire is supported by means of a number of ribs placed side by side and which extend across the width of the wire. The lower wire rests against the ribs, and the ribs are pressed adjustably against the lower wire. In this construction, the ribs are placed tightly adjacent to one another which results in the drawback that the ribs act upon one another by the intermediate of friction, for which reason it is difficult to provide a precise control of the loading provided by the ribs. From DE Patent No. 3,153,305, a wire guide path is known in which a number of ribs are employed. The ribs are arranged at a distance from one another, and rest and are supported against the lower wire. The pressing of these ribs against the lower wire is adjusted individually by means of spring members.

From Finnish Patent No. 90,572, a construction is known in which the loading ribs are loaded against the lower wire by means of loading hoses arranged parallel to the longitudinal direction of the ribs, i.e., transverse to the running direction of the wires. The desired compression of the ribs against the lower wire is produced by regulating the pressure in the hoses. By means of the construction in accordance with this Finnish patent, each rib can be loaded with a force of the desired magnitude against the lower wire, e.g., such that the loading of the ribs increases in the running direction of the wires.

It has been a substantial drawback of the prior art constructions described above that it has not been possible to make the moisture content of the web in the cross direction, i.e., the direction across the web width, uniform. Rather, in the prior art constructions mentioned above, the moisture curve or moisture profile in the cross direction has become such that the moisture content in the web is considerably higher in the lateral areas of the web than in the middle areas of the web. This results primarily from the fact that the rib is loaded against the lower wire substantially with a uniform load, in which case the rib that "floats" on a loading hose subjected to a uniform pressure behaves such that, owing to the points of discontinuity, at the ends of the rib, a torque is formed which attempts to bend the rib. Thus, by means of the uniform loading of the rib, a uniform compression of the rib against the lower wire is not achieved across the entire web width. In the prior art, attempts have been made to solve this adjustability or profiling in the cross direction, among other things, so that, for example, in a construction in accordance with Finnish Patent No. 90,572, the loading hose placed below each rib has been divided into separate chambers in the longitudinal direction of the rib, and the pressure in each of the chambers is separately adjustable. By means of such a construction, adjustability in zones of the loading of the ribs is achieved, but the actual implementation and realization of this construction is highly complicated and quite difficult to control.

OBJECTS AND SUMMARY OF THE INVENTION

It is an object of the present invention to provide an improvement over the prior art constructions described above and to eliminate the drawbacks involved in those constructions.

It is another object of the present invention to provide a new and improved loading box including loading ribs and method for loading a set of loading ribs in a loading box in which the ribs can be loaded locally at discrete locations in the cross direction.

In view of achieving these objects and others, the loading box in accordance with the invention is provided with loading means arranged to produce a locally raising or lowering force applied to the loading ribs in the direction transverse to the transfer direction. This force is applied simultaneously to at least two successive loading ribs so as to profile the compression force applied by the loading ribs to the fibrous pulp in the transverse direction.

By means of the present invention, compared with the prior art constructions, a number of significant advantages are obtained. In particular, in accordance with the invention, regulation of the loading of the ribs in the cross direction is accomplished by means of oblong power elements arranged in the running direction of the wires. The oblong power elements act in an opposite direction, as compared with the conventional loading elements arranged parallel to the longitudinal direction of the ribs, such that the profiling of the loading is carried out by means of the same loading elements at the same time in two or more ribs. In this case, the controllability and the stability of the loading is substantially better than in the prior art constructions. Moreover, streaks that occurred in the fibrous pulp which arose from the prior art loading boxes can be amended more readily because the oblong loading elements are parallel to the streaks. In the lateral areas of the web, where the profiling is particularly important, the loading elements in accordance with the invention can be arranged more densely than in the rest of the web, in which case the controllability of the lateral areas is also better than in the prior art constructions. It is a substantial advantage of the present invention that it is easy to correct major errors and profile faults and, in addition, the invention can also be applied to correcting small-scale profile faults.

In one embodiment, the loading box for a web former of a paper or board machine in accordance with the invention comprises loading ribs extending in a first direction across substantially the entire width of the web, first loading means for loading the loading ribs to produce compression, and second loading means arranged in the loading box for applying a varying force to at least two adjacent ones of the loading ribs at at least one discrete location in the first direction to profile the compression force applied by the loading ribs. The second loading means preferably are arranged to apply a force to the loading ribs at a plurality of discrete locations in the first direction and comprise longitudinal support beams extending in a second direction perpendicular to the first direction, a loading hose arranged on each of the support beams, and a support construction interposed between each of the loading hoses and at least two adjacent ones of the loading ribs.

In the method for loading a set of loading ribs in a loading box in accordance with the invention, whereby the loading ribs extend in a first direction across substantially the entire width of the web, the loading ribs are loaded to produce compression and a force is applied to at least two adjacent ones of the loading ribs at at least one discrete location in the first direction to profile the compression force applied by the loading ribs.

Further advantages and characteristic features of the invention will come out from the following detailed description of the present invention.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
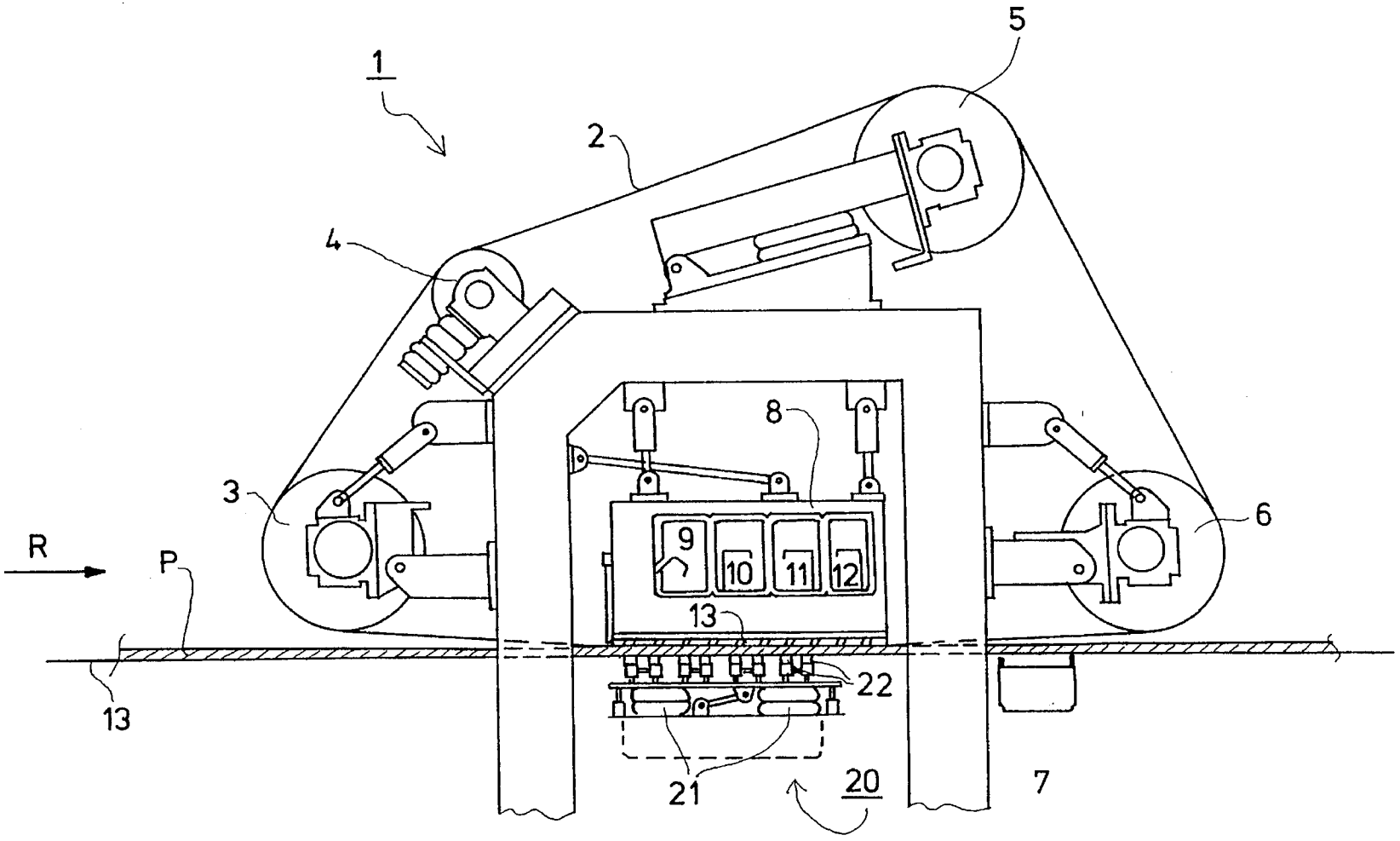
FIG. 1 is a side view of a former to which the loading box adjustable in zones in accordance with the invention can be applied.

Referring to the accompanying drawings wherein similar reference numerals refer to like or similar elements, FIG. 1 is a fully schematic side view of a former, which is denoted generally by reference numeral 1. The former 1 is a so-called twin-wire former which comprises an upper-wire loop 2 and a lower-wire loop 13. The former 1 may be installed, for example, on a fourdrinier wire, in which case the lower-wire loop 13 is the fourdrinier wire. In a conventional manner, the upper-wire loop 2 is arranged to run over turning rolls 3,4,5,6 which are mounted adjustably on a frame 7 of the former 1. The first turning roll 3 is not in contact with a fibrous pulp P, but it has been raised apart from the web so that a wedge-shaped inlet portion is formed between the wire loops 2,13 in which the fibrous pulp P placed on the lower-wire loop 13 is pressed continuously between the wires 2,13 in its transfer or running direction R.

In the former 1, after the wedge-shaped inlet portion in the transfer direction R, a drain box 8 is arranged in a conventional manner inside the upper-wire loop 2. A bottom face or portion of the drain box comprises upper ribs 13 whereby water is sucked through gaps between the ribs out of the fibrous pulp P through the upper wire 2 and into the drain box 8 by means of a vacuum. The drain box 8 contains drain chambers 9,10,11,12 in which the vacuum is maintained. By means of the vacuum in chambers 9,10,11,12, water is sucked out of the fibrous pulp P. In the different chambers 9,10,11,12, preferably vacuums each having a different magnitude are employed, i.e., different degrees of negative pressure, such that the efficiency of dewatering of the fibrous pulp P progressively increases in the direction of transfer R.

A loading box 20 is arranged below the drain box 8 underneath the lower wire 13 preferably in opposed relationship thereto. The lower wire 13 is pressed from below by means of loading ribs 22 provided on the loading box 20 so that a compression force of a desired magnitude is produced and applied to the fibrous pulp P present between the wires 2,13 in order to drain water out of the fibrous pulp P. The loading ribs 22 extend substantially across the entire width of the pulp-carrying wire 13 and are provided with suitable power members or loading means, such as loading hoses situated parallel to the loading ribs 22. A desired compression effect is thus produced upon the fibrous pulp P by means of compressed air passed into the loading hoses to pressurize the same. The loading ribs 22 are loaded by means of the loading hoses preferably so that the compression effect applied to the fibrous pulp P by means of these loading ribs 22 progressively increases in the transfer direction R. The loading ribs 22 are mounted on a loading board placed in the loading box 20. Below the board, bellows 21 or equivalent power units are mounted for regulating the desired pressure level and the inclination of the loading board. The regulation of the inclination of the loading board results in the regulation of the loading ribs 22 present therein to the desired level in relation to the direction of transfer R. The construction of the loading box 20 is illustrated in more detail in FIGS. 2, 3 and 4.

Figure 2:
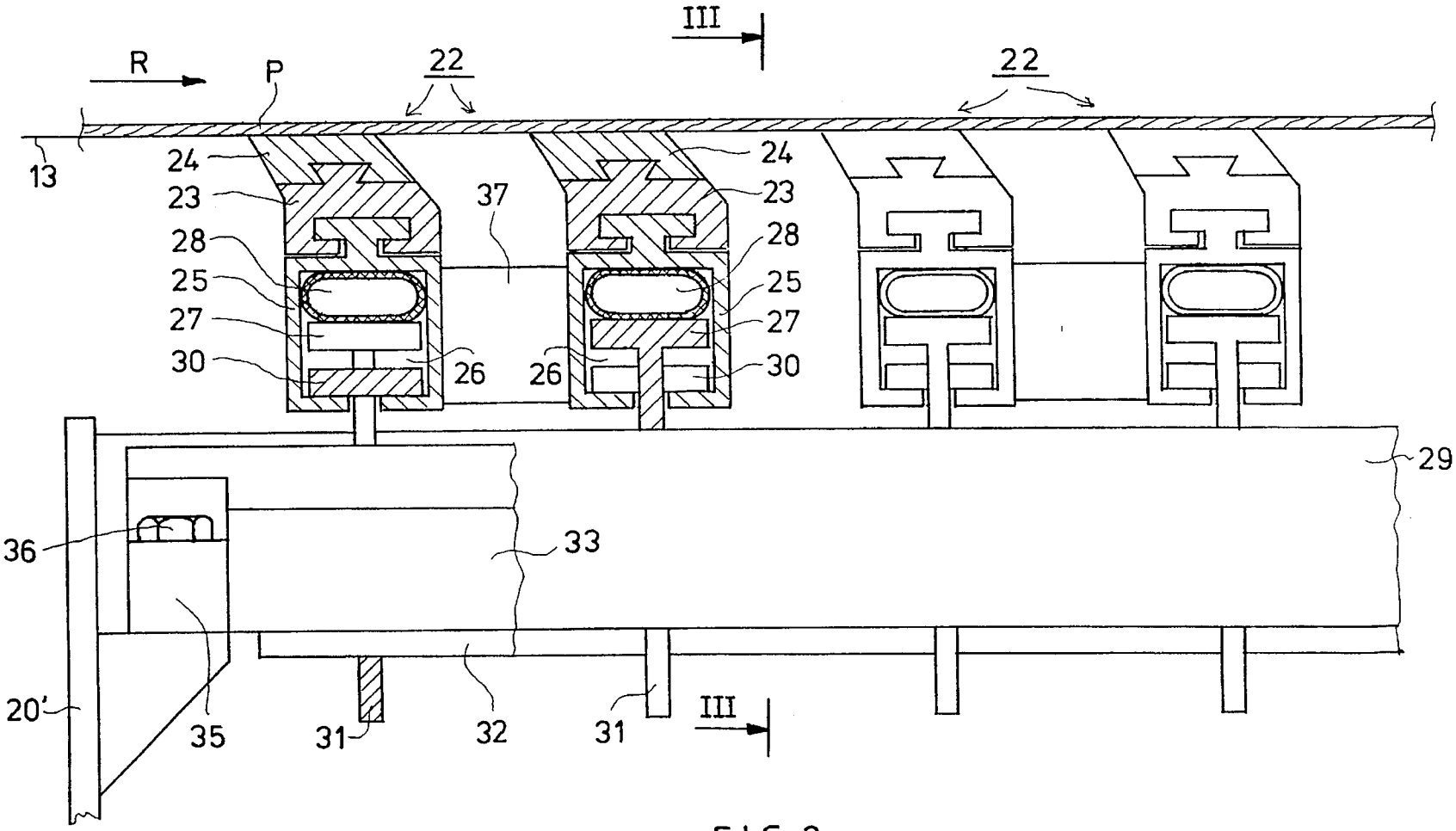
FIG. 2 shows an enlarged detail of the area of the loading box in the former as shown in FIG. 1, in particular illustrating the mode in which the possibility of loading of the ribs is achieved.
Figure 3:
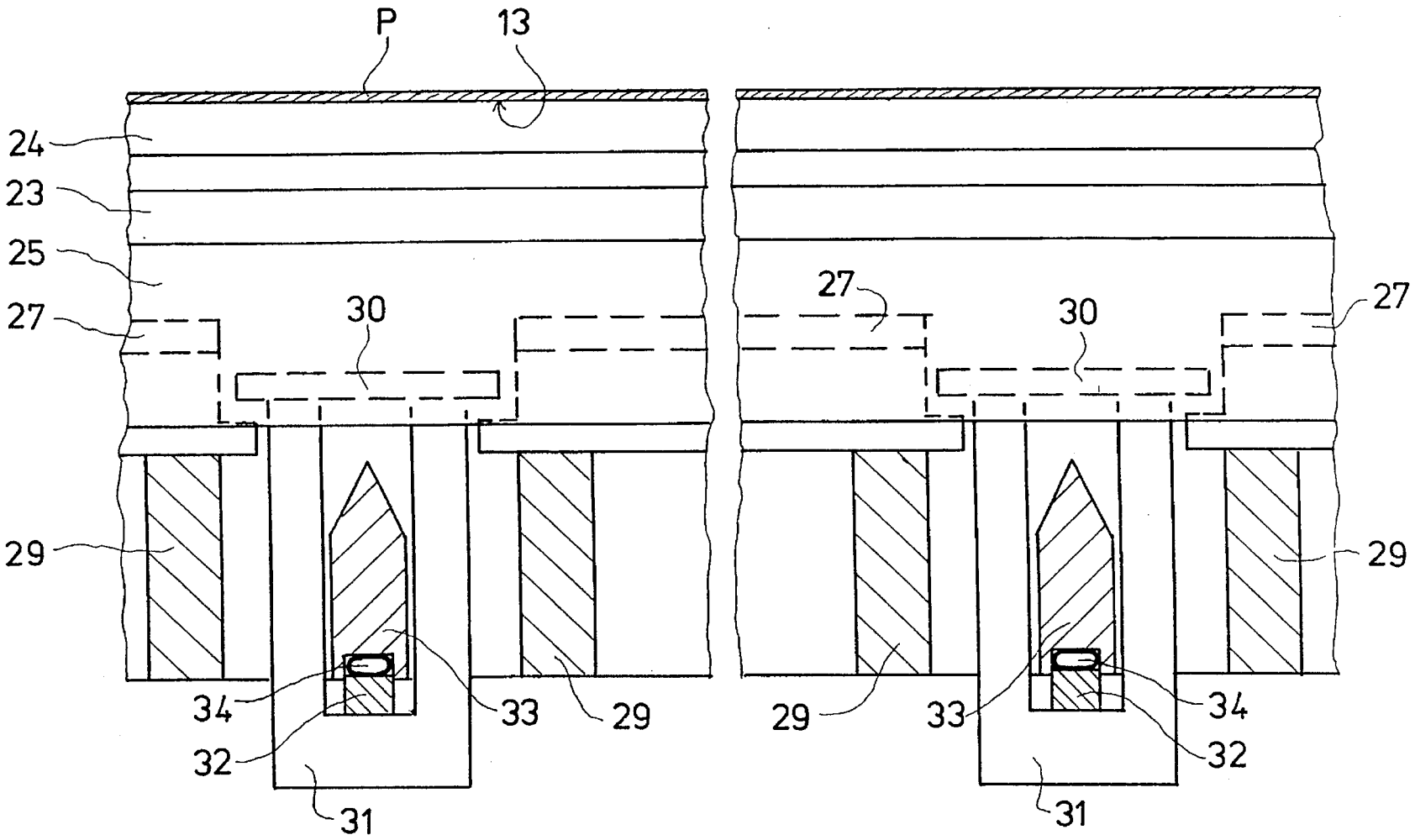
FIG. 3 is a sectional view taken along the line III—III in FIG. 2.
Figure 4:
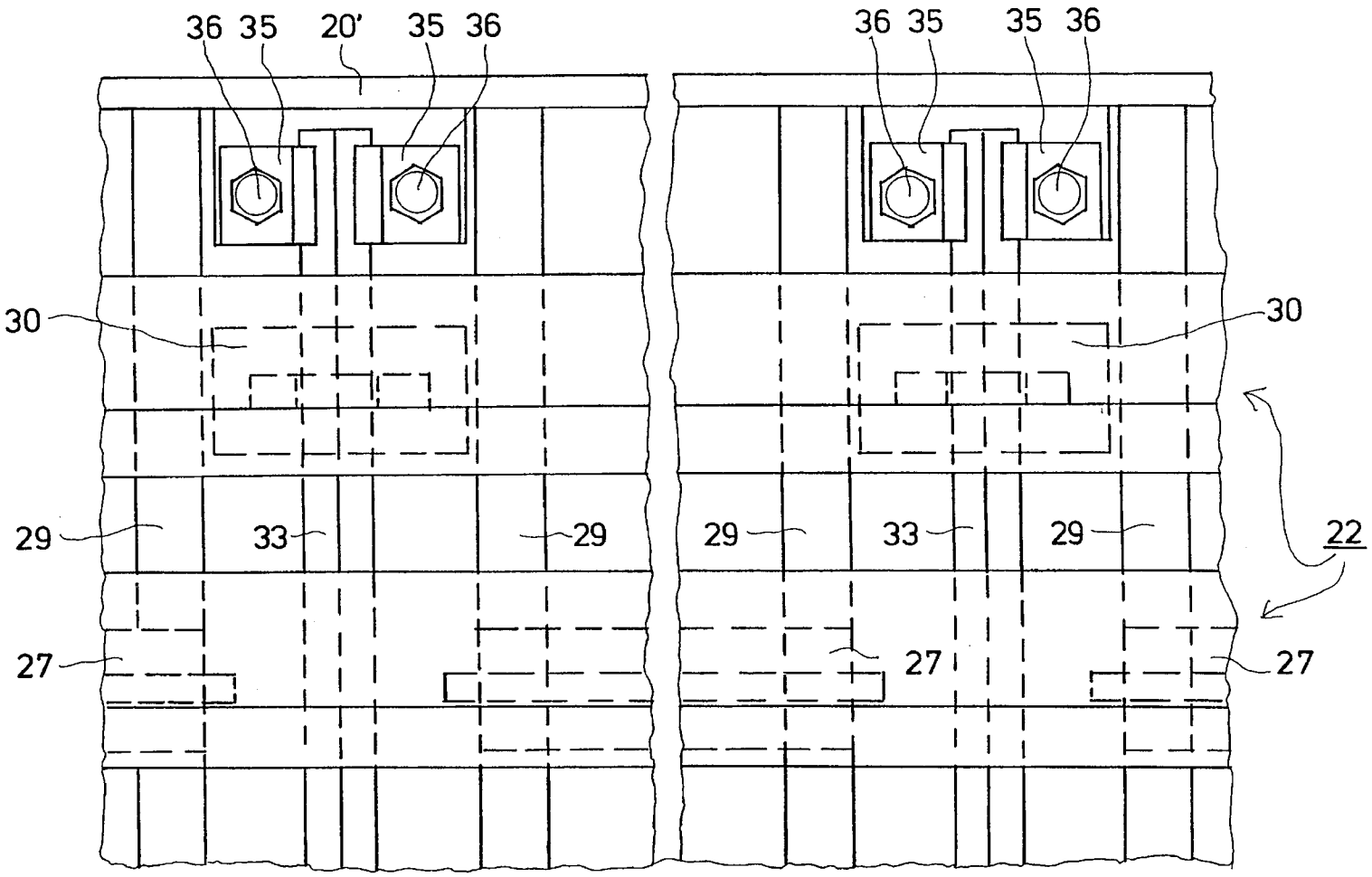
FIG. 4 is a view of the loading board as shown in FIG. 2, viewed from the direction of the wires.

FIG. 2 shows details of the loading box 20 shown in FIG. 1, in particular illustrating the adjustability of the loading ribs 22. FIG. 3 is a schematic partial sectional view taken along the line III—III in FIG. 2, and FIG. 4 is a schematic illustration of the construction of the loading ribs viewed from the top, i.e., from the direction of the wires. As shown most clearly in FIG. 2, the loading ribs 22 each comprise a body 23 to which a wear piece 24 is attached by means of a dovetail joint or equivalent. Wear piece 24 rests against the bottom face of the lower wire 13. The body 23 of the loading rib is mounted on a hollow beam 25 arranged substantially parallel to the longitudinal direction of the loading rib. The body 23 is fixed to beam 25 in a suitable manner, for example by means of a backed-off joint shown in FIG. 2. In a cavity space 26 in the hollow beam 25, a loading member arranged parallel to the longitudinal direction of the loading rib is fixed, preferably a loading hose 28 as shown in FIG. 2, and below the loading hose 28, adjustment wedges 27 are arranged which are supported on support beams 29 in a direction parallel to the machine direction. Thus, by means of a pressure fed into the loading hoses 28 to pressurize the same, the loading ribs 22 are loaded with the desired force against the lower wire 13.

As shown in FIG. 2, in the transfer direction, the successive loading ribs 22 are preferably interconnected in pairs by means of connecting members 37. Into the loading hoses 28 in each loading rib 22 or, in the arrangement as shown in FIG. 2, into the loading hoses 28 in each pair of ribs, the desired adjustable pressure is fed so as to produce the desired compression force applied to the fibrous pulp P placed between the wires. Pressure supply and regulation members are not shown in the illustrated embodiments, but these pressure supply and regulation members can be accomplished by means of existing prior art constructions.

In the construction of ribs of the sort described above, it is desirable to be able to locally regulate the compression force applied by the loading ribs 22 to the fibrous pulp P in the direction transverse to the direction of transfer R, i.e., the cross direction or the longitudinal direction of the loading ribs 22. This local regulation of the loading in the cross direction, i.e., profiling of the loading in the cross direction of the machine at discrete locations in the cross direction, is accomplished in the invention as follows. In the loading board, which forms a part of the loading box 20 and a part of which is denoted by reference 20' in FIGS. 2 and 4, longitudinal support beams 33 are installed and extend in the longitudinal direction of the machine, i.e., in the transfer direction R. Beams 33 are rigidly attached to the loading board 20' by means of dedicated fastening means 35,36, e.g., nuts and bolts. There are a number of such longitudinal beams 33 attached to the loading board, and they are arranged at a distance from one another in the cross direction of the machine. As will be detailed below with reference to FIG. 6, the longitudinal beams 33 are preferably arranged such that the distances between them in the cross direction of the machine are shorter in the lateral areas of the wires 13,2 than in the middle area of the wires. On support of the hollow beams 25 of the loading ribs 22, and more particularly on flanges formed at a bottom of the beams 25, U-section support pieces 31 are suspended. Specifically, flange parts 30 of support pieces 31 are supported against the bottom of the cavity space 26 in the hollow beams 25 of the loading ribs 22.

As shown in particular in FIG. 3, the U-section support pieces 31 surround the support beams 33 placed in the machine direction so that the longitudinal support beams 33 remain inside the U-section support pieces 31. On the bottom of the "fork" of the U-section support pieces 31, longitudinal supports 32 are installed and extend across the length of the loading box. Onto these longitudinal supports 32 in a position between the longitudinal supports 32 and the support beams 33 placed in the machine direction, longitudinal loading hoses 34, or other loading means, are arranged. The longitudinal loading hoses 34 may extend across the entire length of the loading box 20, but it is important that the longitudinal loading hoses 34 should extend at least across two successive loading ribs 22 as shown in FIG. 4. In such a case, between the longitudinal support 32 and the support beam 33 placed in the machine direction, a number of longitudinal loading hoses 34 are arranged one after the other. If the longitudinal loading hoses 34 extend across two successive loading ribs 22, it is preferable that, in such a case, they extend over those adjacent loading ribs 22 that have been interconnected as a pair of ribs by means of connecting members 37. When the desired loading pressure is fed into the longitudinal loading hoses 34, a force is applied to the loading ribs 22 which pulls the ribs 22 apart from the wire plane at only that location at which the loading hoses 34 are present, i.e., to provide a local loading force in a downward direction resulting from the downward movement of support piece 31. Thus, by means of this construction, an effect is produced that reduces the compression force applied by the loading ribs 22 to the fibrous pulp P in the areas of the longitudinal loading hoses 34. In this manner, it is possible to correct the streak formations and other profile faults in the fibrous pulp.

Figure 3A:
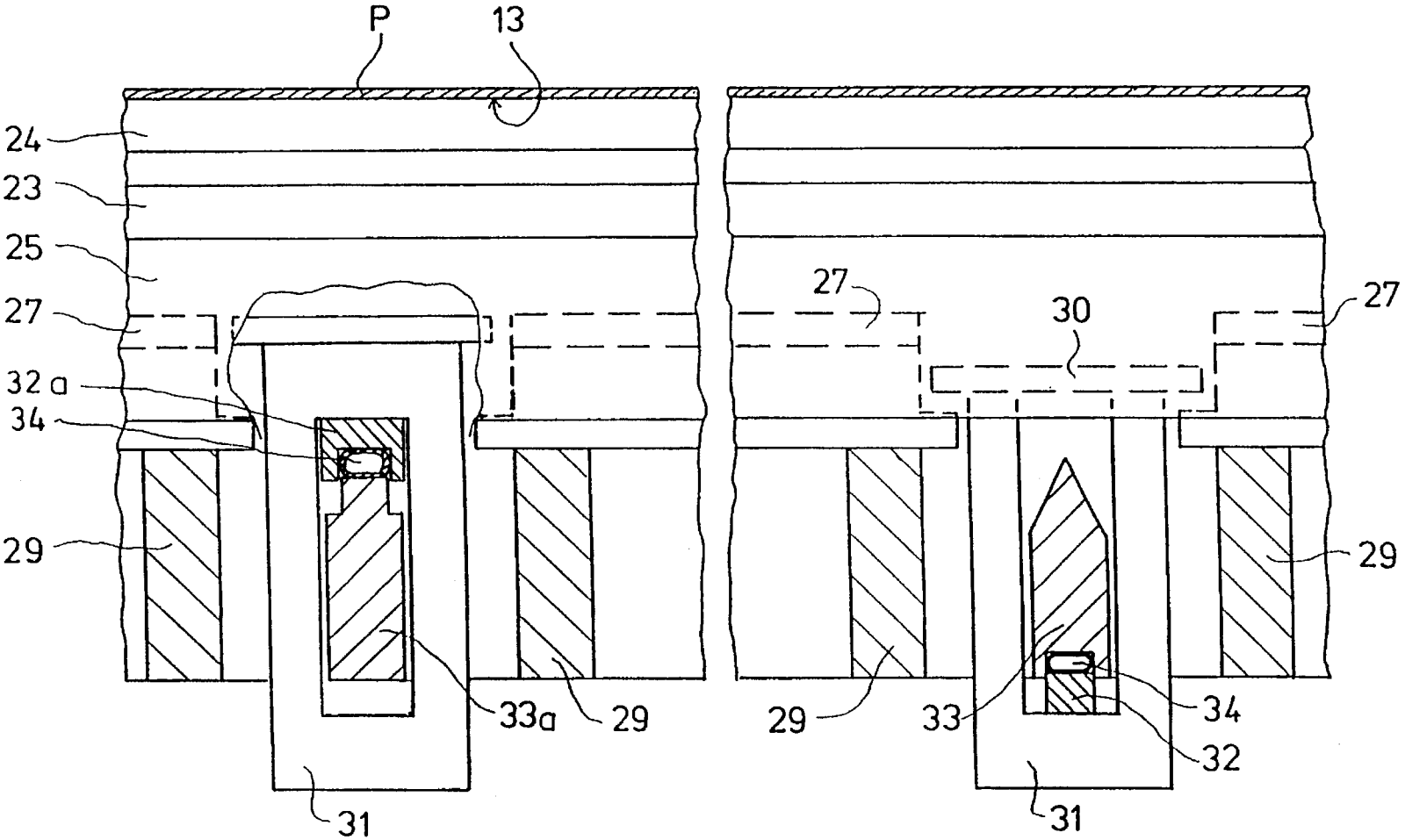
FIG. 3A is an alternative sectional view taken along the line III—III in FIG. 2.

In the embodiment shown in FIG. 3A, inversely in relation to the embodiment shown in FIG. 3, the longitudinal loading member of on the left is arranged so that it produces a force that increases the force that is applied by the loading ribs 22 to the wire-carrying web. In this case, the adjustment in zones in accordance with the invention can also be carried into effect. In this embodiment, the loading member comprises a loading hose 34 mounted above a longitudinal support beam 33*a*. A longitudinal support 32*a* is installed on the support piece 31 above the loading hose 34 and extends across the length of the loading box. Support piece 31 thus extends over support 32*a* such that upon pressurization of loading hose 34, support 32*a* is moved upward causing support piece 31 to be moved upward so as to apply a raising force to the loading ribs 22 at that locations in the cross direction at which the support beams 33*a* is located.

Figure 5A:
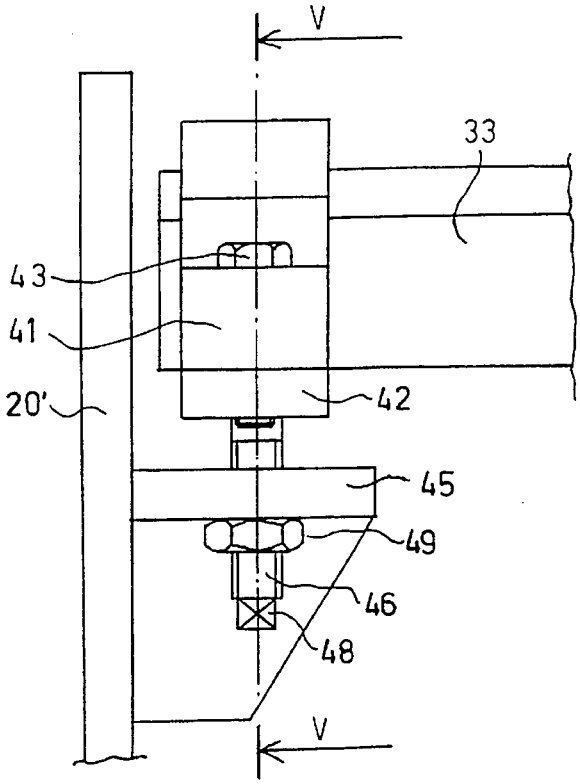
FIG. 5A is a side view of fastening and adjustment unit used in the loading box in accordance with the invention.
Figure 5B:
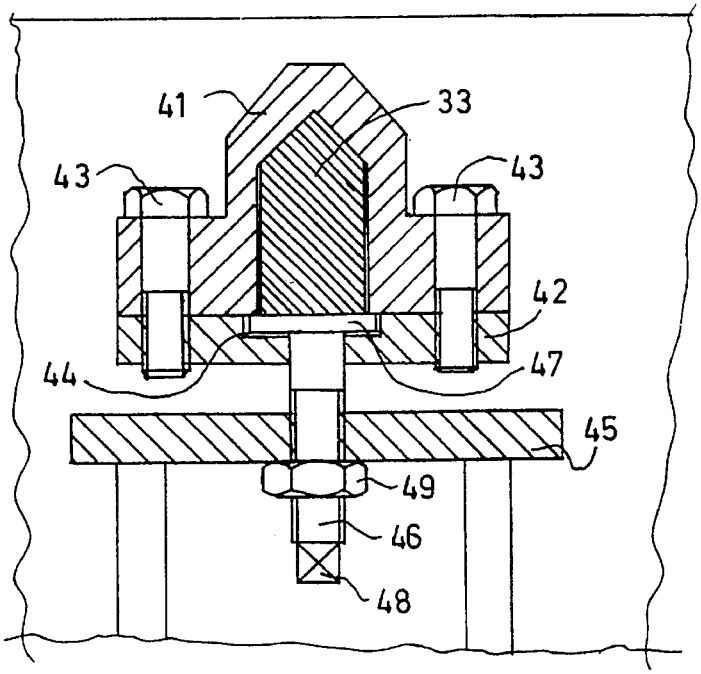
FIG. 5B is a sectional view taken along the line V—V in FIG. 5A of the fastening and adjustment unit used in the loading box in accordance with the invention.

FIGS. 5A and 5B show an embodiment of the invention wherein the longitudinal support beams 33 are adjustably mounted by fastening means and adjusting means to the loading box 20. The fastening means comprise a clamp 41, a bracket 42 and fastening screws 43 for securing the clamp 41 to the bracket 42. As shown most clearly in FIG. 5B, a cavity 44 is formed in the upper face of the bracket 42 upon securing of clamp 41 to bracket 42. The adjustment means comprise a male-threaded adjusting screw 46 having a flange 47 on one end and a torsion pin 48 on an opposite end. The flange 47 is arranged in the cavity 44 of the bracket 42 and the screw is driven in a hole formed in a support plate 45. The hole is provided with a female threaded mateable with the male-threaded screw 46. In this manner, it is possible to adjust the position of the support beams 33 by turning adjusting screw 46. A conventional mechanical device can be connected to the torsion pin 48 to drive the adjusting screw and thereby adjust the position of the beam 33. A locknut 49 may be provided in order to lock the adjusting screw 46 in a desired position.

Figure 6:
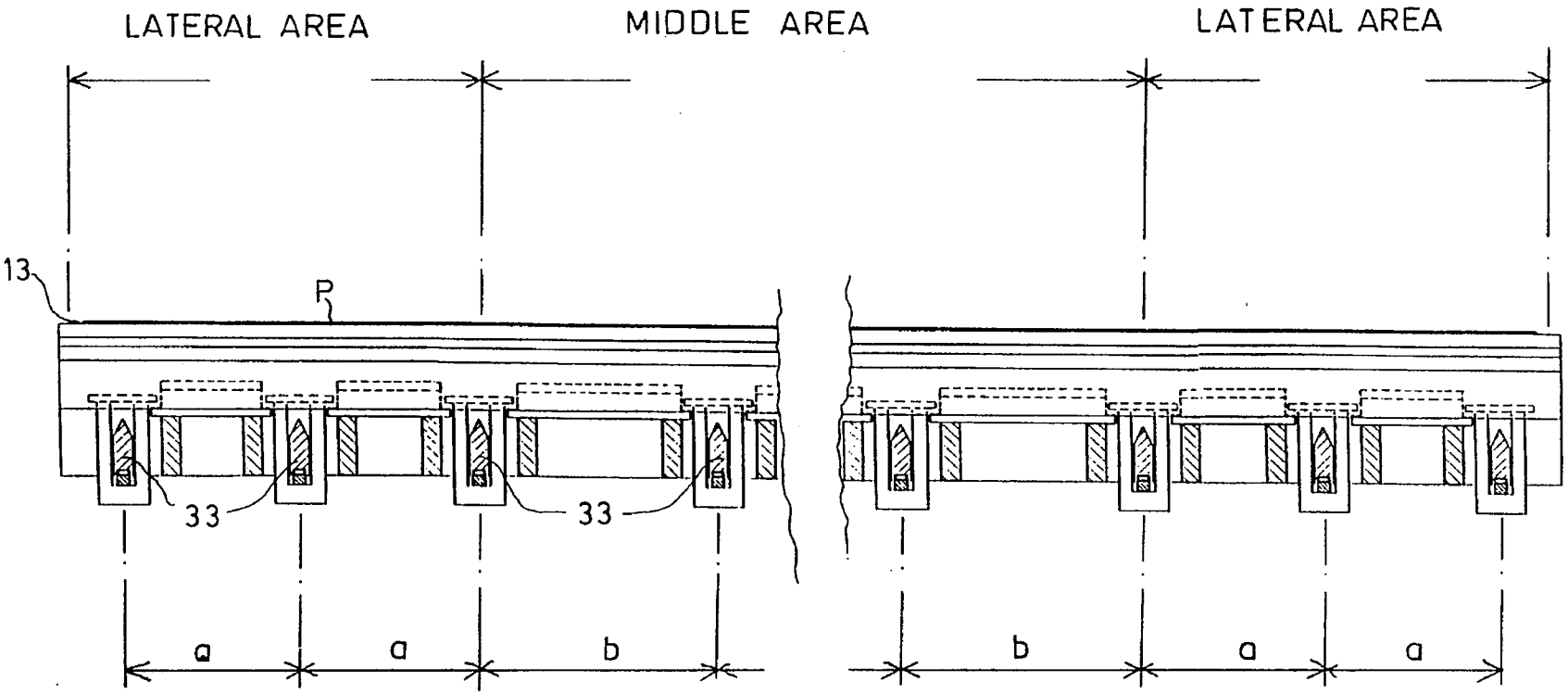
FIG. 6 is a larger sectional view taken along the line III—III in FIG. 2 extending over the web width or wire width.

FIG. 6 illustrates the embodiment of the invention wherein the spacing of the longitudinal support beams 33 in the direction transverse to the direction of transfer of the web, i.e., transverse to the running direction, is varied. Thus, in lateral areas of the wires, the distance a between adjacent ones of the longitudinal support beams 33, and related power units 34 from one another is smaller than the distance b between adjacent ones of the longitudinal support beams 33, and related power units 34 from one another in a middle area of the wires. Other variable support beam spacing arrangements may of course be applied.

The embodiment described above and illustrated in the figures in the drawing is just one example of the manner in which the adjustment in zones of the loading box 20 in the former 1 can be accomplished. First, it is obvious that, instead of the longitudinal loading hoses 34, it is also possible to use power units of other types, for example mechanical power units. In such a case, it would be one possibility that invariable pressures are arranged to act upon the longitudinal loading hoses 34, in addition to which the longitudinal support would be taken care of by means of mechanically adjustable power units. Further, it is possible to imagine a construction in which, at every other longitudinal support beam 33, a force is produced that increases the compression applied by the loading ribs 22, and in a corresponding manner, at every other longitudinal support beam 33, a force is produced that reduces the compression. It is also obvious that the loading box in accordance with the invention can be applied in web formers with constructions different than that shown in the drawings.

The examples provided above are not meant to be exclusive. Many other variations of the present invention would be obvious to those skilled in the art, and are contemplated to be within the scope of the appended claims.

I claim:

1. In a loading box for a former of a paper or board machine, the former comprising a twin-wire section in which two wires run one above the other and in a transfer direction, said twin-wire section including a drain box mounted at one side of the wires for removing water from a web running between the wires, a loading box mounted at an opposite side of the wires from the drain box, said loading box including loading ribs extending in a direction transverse to the transfer direction across substantially the entire width of the web, and said loading ribs being loaded to produce compression in the web, the improvement comprising loading means arranged in said loading box for applying a local force simultaneously to at least two successive ones of said loading ribs at at least one discrete location in the direction transverse to the transfer direction to profile the compression force applied by said at least two loading ribs to the web, said loading means comprising a longitudinal support beam arranged at said at least one discrete location in the direction transverse to the transfer direction, and power means arranged on said support beam such that upon actuation thereof, the local force is applied to said at least two loading ribs, said power means comprising a pressurizable loading hose arranged parallel to said support beam, said loading hose being pressurized to load said at least two loading ribs, wherein said loading ribs are arranged at an upper part of said loading box, said support beam is arranged underneath said loading ribs, and said loading hose is mounted below said support beam, and a support piece at least partially interposed between said loading ribs and said loading hose and structured and arranged such that upon pressurizing said loading hose, a downward force is applied to said at least two loading ribs via said support piece.

2. The loading box of claim 1, further comprising fastening means for rigidly fastening said longitudinal support beam to said loading box.

3. The loading box of claim 1, further comprising fastening and adjusting means for adjustably mounting said longitudinal support beam on said loading box, said fastening and adjusting means comprising means for displacing said support beam such that the magnitude of the force applied to said at least two loading ribs is regulatable by adjusting the position of said support beam.

4. The loading box of claim 3, wherein the adjustment of the position of said longitudinal support beam is carried out mechanically.

5. The loading box of claim 1, wherein a constant pressure acts upon said loading hose.

6. The loading box of claim 1 further comprising a loading board comprising support beams, each of said loading ribs comprising a hollow beam, a transverse loading hose situated in said hollow beam, and adjustment wedges mounted on said support beams, extending into said hollow beam and supporting said transverse loading hose in said hollow beam.

7. The loading box of claim 6, wherein said loading means are arranged to apply a force to said loading ribs at a plurality of discrete locations in the direction transverse to the transfer direction, said support piece comprising a flange part extending into said hollow beam.

8. The loading box of claim 1 further comprising connecting means for interconnecting adjacent ones of said loading ribs in pairs.

9. The loading box of claim 1, wherein said longitudinal support beam extend between said at least two ribs.

10. The loading box of claim 1, wherein said support piece has a flange part arranged in connection with said at least two loading ribs and a U-shaped member suspended from said flange part to thereby define an interior region of said support piece, said loading hose and said longitudinal support beam being arranged to extend through said interior region of said support piece.

11. The loading box of claim 10, wherein said support piece further comprises a longitudinal support extending into said interior region and cooperating directly with said loading hose.

12. A loading box for a web former of a paper or board machine, comprising loading ribs extending in a first direction across substantially the entire width of the web, said loading ribs being arranged at an upper part of said loading box, first loading means for loading said loading ribs to produce compression in the web, and second loading means for applying a local force simultaneously to at least two adjacent ones of said loading ribs at at least one discrete location in the first direction to profile the compression force applied by said at least two loading ribs, said second loading means comprising at least one longitudinal support beam arranged at said at least one discrete location in the first direction and at a location underneath said loading ribs, and at least one pressurizeable loading hose arranged on and substantially parallel to a respective one of said at least one support beam such that upon pressurization thereof, the local force is applied to said at least two loading ribs, said at least one loading hose being mounted below said respective support beam, and at least one support piece at least partially interposed between said loading ribs and a respective one of said at least one loading hose structured and arranged such that upon pressurization of said at least one loading hose, a downward force is applied to said at least two loading ribs via said at least one support piece.

13. The loading box of claim 12, wherein said second loading means apply a force to said loading ribs at a plurality of discrete locations in the first direction, said at least one support beam comprising a plurality of longitudinal support beams each arranged at one of said discrete locations and extending in a second direction transverse to the first direction, said at least one loading hose comprising a plurality of loading hoses each arranged on a respective one of said support beams, and said at least one support piece comprising a plurality of support pieces each interposed between one of said loading hoses and respective ones of said loading ribs.

14. A method for loading a set of loading ribs in a loading box for a web former of a paper or board machine, said loading ribs extending in a first direction across substantially the entire width of the web, comprising the steps of:

loading said loading ribs to produce compression, and applying a local force simultaneously to at least two adjacent ones of said loading ribs at a plurality of discrete locations in the first direction to profile the compression force applied by said at least two loading ribs, arranging a plurality of longitudinal support beams extending in a direction transverse to the first direction between said at least two loading ribs, one at each of said discrete locations, mounting an elongate loading hose to each of said support beams such that said loading hose is operative against said support beam, and selectively pressurizing said loading hoses to locally adjust the compression profile of said loading ribs.

15. The method of claim 14, further comprising the step of applying a local force to all of said loading ribs at said at least one discrete location in the first direction.

16. The method of claim 14, further comprising the step of varying the spacing of said support beams such that the distance between adjacent ones of said support beams is smaller in lateral areas of the web than in a middle area of the web.

17. In a loading box for a former of a paper or board machine, the former comprising a twin-wire section in which two wires run one above the other and in a transfer direction, said twin-wire section including a drain box mounted at one side of the wires for removing water from a web running between the wires, a loading box mounted at an opposite side of the wires from the drain box, said loading box including loading ribs extending in a direction transverse to the transfer direction across substantially the entire width of the web, and said loading ribs being loaded to produce compression in the web, the improvement comprising loading means arranged in said loading box for applying a local force simultaneously to at least two successive ones of said loading ribs at a plurality of discrete locations in the direction transverse to the transfer direction to profile the compression force applied by said at least two loading ribs to the web, said loading means comprising a plurality of longitudinal support beams one for each of said discrete locations, said support beams being variably spaced from one another in the direction transverse to the transfer direction such that the distance between adjacent ones of said longitudinal support beams is smaller in lateral areas of the wires than in a middle area of the wires.

18. In a loading box for a former of a paper or board machine, the former comprising a twin-wire section in which two wires run one above the other and in a transfer direction, said twin-wire section including a drain box mounted at one side of the wires for removing water from a web running between the wires, a loading box mounted at an opposite side of the wires from the drain box, said loading box including loading ribs extending in a direction transverse to the transfer direction across substantially the entire width of the web, and said loading ribs being loaded to produce compression in the web, the improvement comprising loading means arranged in said loading box for applying a local force simultaneously to at least two successive ones of said loading ribs at at least one discrete location in the direction transverse to the transfer direction to profile the compression force applied by said at least two loading ribs to the web, and a loading board comprising support beams, wherein each of said loading ribs comprising a hollow beam, a loading hose situated in said hollow beam, and adjustment wedges mounted on said support beams, extending into said hollow beam and supporting said loading hoses in said hollow beam.

19. The loading box of claim 18, wherein said loading means are arranged to apply a force to said loading ribs at a plurality of discrete locations in the direction transverse to the transfer direction, said loading means comprising a plurality of longitudinal support beams one for each of said discrete locations, a longitudinal loading hose arranged on each of said support beams and a support piece interposed between said loading ribs and said longitudinal loading hoses, said support piece comprising a flange part extending into said hollow beam.

* * * * *